United States Patent [19]

Masaki et al.

[11] Patent Number: 4,671,090

[45] Date of Patent: Jun. 9, 1987

[54] CYLINDER LOCK ASSEMBLY

[75] Inventors: Mikio Masaki, Tokyo; Toshikazu Kobayashi, Kawasaki, both of Japan

[73] Assignee: Kokusan Kinzoku Kogyo Kabushiki Kaisha, Tokyo, Japan

[21] Appl. No.: 787,050

[22] Filed: Oct. 15, 1985

[51] Int. Cl.[4] ..... E05B 17/18

[52] U.S. Cl. ..... 70/455; 70/423; 70/453; 70/454

[58] Field of Search ..... 70/423, 427, 453–454, 70/455

[56] References Cited

U.S. PATENT DOCUMENTS

| | | | |
|---|---|---|---|
| D. 270,229 | 8/1983 | Zeidman . | |
| D. 270,424 | 9/1983 | Weinerman . | |
| D. 270,707 | 9/1983 | Davis et al. . | |
| 427,423 | 5/1890 | Johnson | 70/423 |
| 2,036,738 | 4/1936 | Zygmunt | 70/455 X |
| 2,261,472 | 11/1941 | Hurd | 70/455 |
| 2,655,031 | 10/1953 | Jacobi | 70/455 |
| 2,690,071 | 9/1954 | Jacobi | 70/455 |
| 2,956,430 | 10/1960 | Simmons | 70/455 |
| 2,988,910 | 6/1961 | Eshbaugh et al. | 70/455 |
| 3,029,626 | 4/1962 | Jacobi | 70/453 |
| 3,263,463 | 8/1966 | Duval et al. | 70/454 |
| 3,754,423 | 8/1973 | Seidewand | 70/455 |
| 4,369,678 | 1/1983 | Cooper et al. | 81/90 |
| 4,413,849 | 11/1983 | Davis | 292/229 |
| 4,423,611 | 1/1984 | Neyret et al. | 70/455 |
| 4,492,394 | 1/1985 | Dignan | 292/64 |

FOREIGN PATENT DOCUMENTS

| | | | |
|---|---|---|---|
| 3215196 | 11/1983 | Fed. Rep. of Germany | 70/455 |
| 794863 | 5/1958 | United Kingdom | 70/455 |
| 1228927 | 4/1971 | United Kingdom | 70/455 |

OTHER PUBLICATIONS

Southco, Inc. No. E3 Vise-Action Latches Leaflet, 1 page, bearing a 1984 copyright notice (date otherwise unknown).

*Primary Examiner*—Thomas J. Holko
*Assistant Examiner*—Suzanne L. Dino
*Attorney, Agent, or Firm*—Fleit, Jacobson, Cohn & Price

[57] ABSTRACT

A cylinder lock includes a rotor rotatably mounted in a bore of a stationary casing. A key passage in the rotor is blocked by a biased shutter which is caused to pivot against the action of a spring when a key is introduced into the key passage. The rotor includes a plurality of separated, spring-urged tumblers which engage with the key in the key passage. A soft-elastic wiper for removing water from the key is positioned in a lateral slot between the entrance of the key passage and a first tumbler. Flaps of the wiper form a normally closed slit which is openable by the force of the key when the key is advanced towards an operational position.

6 Claims, 4 Drawing Figures

CYLINDER LOCK ASSEMBLY

This invention concerns broadly with improvements in and relating to cylinder locks, each using a mechanical key, and having at least part of the cylinder lock, especially the front part thereof, being exposed in its usage to ambient atmosphere containing aqueous moisture, fog, rain drops or the like.

The inventive cylinder locks may be applied to automotive vehicle doors and trunk lids, although the invention is not limited to apply only thereto.

As is commonly known, conventional lock comprises generally a stationary casing and a rotatable rotor mounted therein, the rotor being arranged so that it may be rotated to a certain or other angular position by means of a mechanical key preferably formed into an elongated blade. For this purpose, the rotor is formed at its front surface with a key insertion opening.

With use of such a conventional cylinder lock, it has been experienced that rain drops will invade through said key insertion opening into the interior space of the rotor.

In a rather recently improved cylinder lock intended for avoiding such defect as referred to above, a pivotable shutter member is provided in the interior space of the rotor, said shutter closing normally from inside the key insertion opening under the influence of a back-up spring in order to shut off the water invasion from outside.

When the driver introduces the key blade through the insertion opening, the shutter is forcibly rotated so as to open and to allow the key further to advance into.

Since the return spring for the shutter is rather weak, part of the rushing water as met in the car washing period may frequently invade through the key insertion opening into the interior space of the cylinder rotor, thereby resulting in rusting and corrosion of small metal parts, such as springs and tumblers as met in extended usage of the cylinder lock assembly.

Especially, when the wetted key is introduced into the key cylinder in rainy weather, water drops will be entrained into the inside hollow space of the key cylinder, thereby similar troubles being invited.

Especially in cold winter, the entrained water drops may be frozen and thus, smooth locking and unlocking operations will be disturbed.

It is therefore a main object to provide an improved cylinder lock assembly in which water invasion as met with use of a wetted mechanical key can be effectively prevented.

It is proposed according to the present invention for attaining the foregoing purposes, a cylinder lock assembly comprising a stationary casing and a cylinder rotor having a front key-insertion opening, a key-guide way kept in communication therewith, a series of key-operated tumblers, the front portion of said key guide way having an enlarged front inside space for mounting therein a spring urged shutter normally closing said key-insertion opening from inside, said assembly being characterized by that said rotor is provided with a soft-elastic wiper positioned within said rotor for wiping out occasionally entrained water by the key.

Further, in the inventive cylinder lock assembly, the said wiper comprises a frame portion and a pair of resilient flaps having their root portions made rigid with said frame, the mating edges of said flaps forming a normally closed slit which is, however, openable by receiving a force from the key when it is being advanced towards its operational position.

Further, in the cylinder lock assembly according to the invention, the said wiper is provided at a position selected between enlarged space and the first one of said tumbler series.

Still further, in the inventive cylinder lock assembly, said wiper is arranged crosswise to the key guide way. The said enlarged space is formed with a discharge opening for discharge of the wiped-out water by the wiper. The said stationary casing is formed again with a discharge opening kept in fluid communication with the said discharge opening at said enlarged space for further discharging the wiped-out water towards outside of the assembly.

Further, the said enlarged opening is formed substantially into a cone-cylindrical shape.

Further, the said discharge opening provided at the enlarged space is directing downwards. In the similar way, the said discharge opening provided through the stationary casing is directing again downwards.

In the following, a preferred embodiment of the invention will be described in detail with reference to the accompanying drawings, in which.

Figure 1:
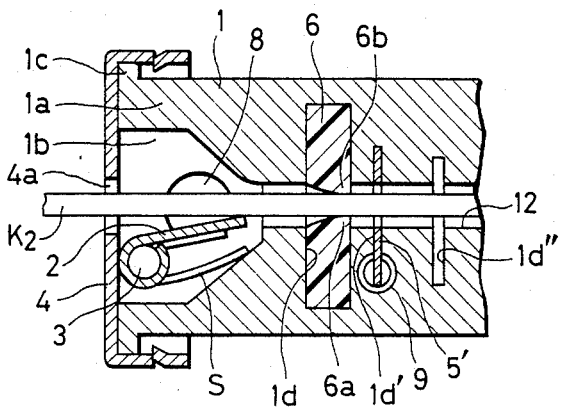
FIGS. 1–3 are respective longitudinal sections of main constituents.
Figure 2:
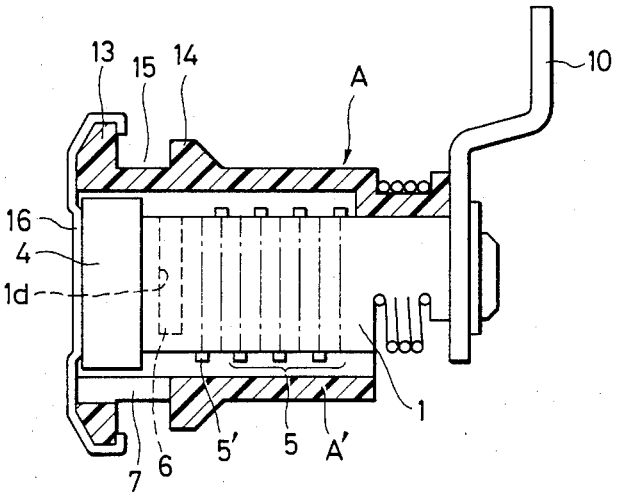

Now referring to the accompanying drawings, character A, FIG. 2, represents a cylinder lock which comprises, as its main constituents, a stationary casing A' and a rotatable rotor 1 mounted therein. The rotor is fitted rigidly on a ring projection 1*c*, FIGS. 1 and 3, formed at its front end or head 1*a*, FIGS. 1 and 3, with a cover or cap 4, FIGS. 1, 3 and 4, having an elongated opening 4*a*, FIGS. 1, 3 and 4, serving for the key-insertion purpose.

Figure 3:
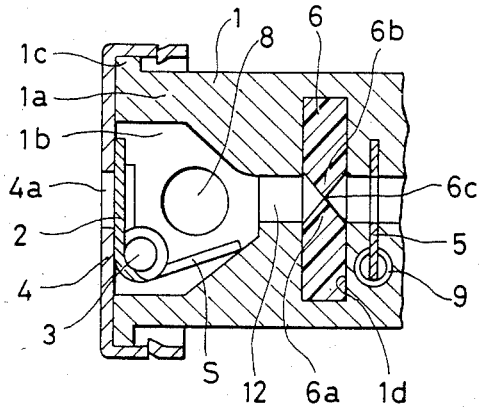

The head 1*a*, FIGS. 1 and 3, of rotor 1 is formed with an axially extending hollow space 1*b* in the form of substantially a cone-cylindrical shape, as seen most clearly in FIGS. 1 and 3.

Numeral 2, FIGS. 1 and 3, represents a shutter member which is pivotably mounted at 3 in the said hollow space 1*b*, an urging spring S being provided for resiliently urging the shutter towards its closing position shown in FIG. 3 relative to the key insertion opening 4*a*. The key is shown generally at K in FIG. 4 in its entire perspective view, as having an enlarged manipulating grip portion K1 and an elongated and serrated working slender portion K2, as is conventional.

Figure 4:
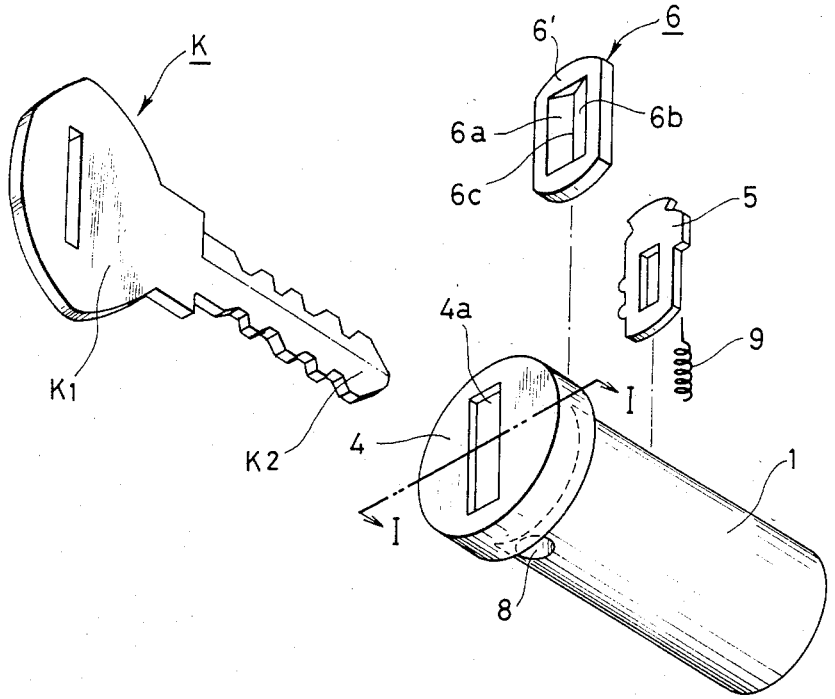
FIG. 4 is an exploded perspective view of several main constituents of the inventive cylinder lock assembly.

A plurality of traversely and alternatingly zig-zag arranged parallel tumblers 5 are slidably provided, as conventionally. This parallel arrangement of tumblers 5 are illustrated only in a highly simplified manner. However, for the purpose of more clear understanding, one of them is shown in FIG. 4, in its full and perspective view, together with its outwardly urging spring 9.

At a small distance from the foremost one of the tumbler series, which is denoted specifically with a dashed reference 5', FIGS. 1 and 2, the rotor 1, FIGS. 1 2 and 3, is formed with a lateral slot 1*d* which may be of a substantially same configuration with that of each of the successive parallel traverse slots 1*d'*, 1*d''* . . . receiving the slidable tumbler series 5. This specific lateral slot 1*d* receives and surrounds opposite lateral edges and opposite sides of a wiper 6 having an opening or window 6*c* normally closed or substantially closed and allowing frictional and wiping pass of the reduced and working portion K2 of key K when the latter has been introduced through the entrance window 4*a* and advanced in and along a longitudinal key guide slot 12 extending along the longitudinal axis of key cylinder 1 and in registration with the key receiving entrance opening 4*a*. The wiper 6 is made preferably of a soft or resilient material such as synthetic rubber, teflon or the like, and comprises a frame-like portion 6′ and a pair of oppositely arranged, mutually cooperating wiper flaps 6*a* and 6*b*, the thickened root portions thereof being made integral with two opposing chords of said wiper frame 6′. There is a forcibly openable slit 6*c* formed by mutually contacting edges of the wiper flaps 6*a*; 6*b*.

Cylinder casing A′ is formed at its front bottom with a discharge opening 7 for finally discharging wiped-out aqueous moisture or water from inside to outside, as will be later more fully described. In FIG. 2, the discharge opening 7 is seen clearly. The casing A′ is formed further with axially separated front and intermediate ring projections 13 and 14, FIG. 2, so as to provide a ring groove 15 formed therebetween, so as to collect part of car washing water. The effective part of the discharge opening 7 penetrates the groove bottom. In addition, a decorating and protecting, thin metal cap 16 covers the front end of the casing A′, for closing the front open end of water-discharge window 7, as shown in FIG. 2.

Numeral 8, FIGS. 1 and 3, represents a water discharge opening, preferably round in its cross-section for ease of fabrication, and formed through the bottom wall of cylinder rotor head 1*a* and within the range of hollow space 1*b*, as is clearly seen in FIGS. 1 and 3. This round opening 8 is kept in fluid communication with the discharge opening 7 for discharge of wiped out water droplets, as will be more fully described hereinbelow.

Numeral 10 represents a camming member which is mechanically connected with a conventional mechanical or electrical door-locking and unlocking mechanism, not shown, for opening the door, not shown, when the key K is pushed through the key insertion opening 4*a* and for operating the specifically selected number of tumblers 5, 5′ towards door-opening position and turned to a certain rotated angle of the lock cylinder 1. This partial rotational movement of the rotor is transmitted through the camming member 10 to the door unlocking and locking mechanism for opening the door which mounts fixedly the assembly A at 15, although not shown.

During this keying operation, the flap 6 is forcibly receded from its entrance window-closing position shown in FIG. 3 to its opening one shown in FIG. 1 by the pushing action provided by the tip end of operational portion K2 of the key. Then, the portion K2 penetrates forcibly through the wiping slit 6*c* of wiper 6, thus aqueous droplets or film if attached onto the key surfaces being effectively wiped out and then discharged through the openings 8 and 7 from inside to outside of the door lock cylinder assembly.

In this way, a double prevention effect against water invasion can be attained.

The embodiments of the invention in which an exclusive property or privilege is claimed are defined as follows:

1. A cylinder lock assembly comprising a stationary casing, a cylinder rotor mounted in said casing, said rotor having a front key-insertion opening and a key guide way defined longitudinally within said rotor and in communication with said front key-insertion opening, a series of key-operated tumblers located within successive parallel transverse slots of said rotor, a front portion of said key guide way having an enlarged front inside space for mounting therein a spring-urged shutter normally closing said key-insertion opening from inside, a lateral slot defined by said rotor of a substantially same configuration as said slots for said tumblers and spaced within said rotor from said enlarged front inside space and adjacent to a first of said series of key-operated tumblers, and a soft-elastic wiper positioned within said lateral slot and surrounded by said rotor for wiping out occasionally entrained water by the key, said wiper including a frame portion engaged at opposite lateral edges and opposite sides by said rotor and a pair of resilient flaps mounted in said key guide way having their root portions made rigid with said frame portion, mating edges of said flaps forming a normally closed slit which is openable by receiving a force from a key when the key is advanced towards an operational position in said key guide way.

2. The cylinder lock assembly of claim 1, wherein said enlarged space is formed with a discharge opening for discharge of the wiped-out water by the wiper.

3. The cylinder lock assembly of claim 2, wherein said stationary casing is formed with a discharge opening kept in fluid communication with the said discharge opening at said enlarged space for further discharging the wiped-out water towards outside of the assembly.

4. The cylinder lock assembly of claim 2, wherein said enlarged space is formed substantially into a cone-cylindrical shape.

5. The cylinder lock assembly of claim 4, wherein said discharge opening provided at the enlarged space is directing downwards.

6. The cylinder lock assembly of claim 3, wherein said discharge opening provided through the stationary casing is directing downwards.

* * * * *